US006591874B2

(12) United States Patent
Credle, Jr.

(10) Patent No.: US 6,591,874 B2
(45) Date of Patent: Jul. 15, 2003

(54) PROCESS FOR THE MANUFACTURE AND DELIVERY OF SMALL BEVERAGE POUCHES

(75) Inventor: William S. Credle, Jr., Stone Mountain, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 10/217,820

(22) Filed: Aug. 12, 2002

(65) Prior Publication Data

US 2002/0190080 A1 Dec. 19, 2002

Related U.S. Application Data

(62) Division of application No. 09/547,089, filed on Apr. 11, 2000, now abandoned.

(51) Int. Cl.[7] ..... B65B 61/00

(52) U.S. Cl. ..... 141/10; 141/114; 52/452; 222/92; 222/105; 222/181.2

(58) Field of Search ..... 222/1, 105, 107, 222/181.2, 92; 141/10, 114; 53/452, 453

(56) References Cited

U.S. PATENT DOCUMENTS

| | | | | |
|---|---|---|---|---|
| 3,463,358 A | | 8/1969 | Wenzler | 222/105 |
| 4,473,989 A | * | 10/1984 | Tsutsumi et al. | 53/459 |
| 4,484,351 A | | 11/1984 | De Leeuwe et al. | 222/107 |
| 4,512,136 A | * | 4/1985 | Christine | 53/410 |
| 4,634,022 A | | 1/1987 | O'Halloran et al. | 222/181.2 |
| 4,656,813 A | * | 4/1987 | Baldini et al. | 53/410 |
| 4,893,732 A | | 1/1990 | Jennings | 222/109 |
| 4,998,990 A | | 3/1991 | Richter et al. | 222/92 |
| 5,147,071 A | | 9/1992 | Rutter et al. | 222/92 |
| 5,271,111 A | | 12/1993 | Johenning | 141/352 |
| 5,307,955 A | | 5/1994 | Viegas | 222/107 |
| 5,609,195 A | | 3/1997 | Stricklin et al. | 141/346 |
| 5,697,410 A | | 12/1997 | Rutter et al. | 141/352 |
| 5,806,717 A | | 9/1998 | De Rosenzeig-Page et al. | 222/105 |
| 6,053,360 A | | 4/2000 | Rutter | 222/105 |
| 6,056,158 A | | 5/2000 | Rossetti et al. | 222/105 |
| 6,092,695 A | | 7/2000 | Loeffler | 222/181.2 |
| 6,182,426 B1 | * | 2/2001 | Pritchard | 53/551 |
| 6,200,300 B1 | | 3/2001 | Petriekis et al. | 222/92 |
| 6,209,756 B1 | | 4/2001 | Van Der Heijden | 222/105 |
| 2002/0088201 A1 | * | 7/2002 | Siccardi | 53/131.5 |

FOREIGN PATENT DOCUMENTS

| | | |
|---|---|---|
| DE | 86 08 435 | 6/1986 |
| DE | 40 28 507 | 3/1992 |
| JP | 9-323740 | 12/1997 |
| WO | WO 99/33715 | 7/1999 |
| WO | WO 00/13987 | 3/2000 |
| WO | WO 00/29301 | 5/2000 |

* cited by examiner

*Primary Examiner*—J. Casimer Jacyna
(74) *Attorney, Agent, or Firm*—Sutherland Asbill & Brennan LLP

(57) ABSTRACT

A pouch for dispensing a beverage. The pouch includes a pair of opposing walls with a first half and a second half. A valve is inserted within one of the walls at the first half of the pouch. The valve is configured to be operable with a beverage dispenser. The pouch also includes various elements for hanging the pouch by its second half such that the pouch may be hung and dispense the beverage through the valve.

11 Claims, 2 Drawing Sheets

PROCESS FOR THE MANUFACTURE AND DELIVERY OF SMALL BEVERAGE POUCHES

RELATED APPLICATIONS

The present application is a divisional of U.S. patent application Ser. No. 09/547,089, filed on Apr. 11, 2000, now abandoned.

TECHNICAL FIELD

The present invention relates to fluid pouches and more particularly relates to pouches intended for small amounts of a beverage, such as syrups or concentrates, and a method for the delivery and the use of these pouches.

BACKGROUND OF THE INVENTION

Various types of plastic pouches have long been used in the beverage industry to deliver liquids such as syrups or concentrates for carbonated soft drinks, juices, sports drinks, and similar types of beverages. The most common design for the delivery and use of such beverages is a "bag-in-box" package. As the name implies, a bag-in-box package usually includes a pouch positioned within a corrugated box. The pouch is usually a single or a multi-ply thermoplastic bag with a spout and an internal dip strip. The pouch is formed with the internal dip strip and then filled with the beverage through the spout. The pouch generally holds about one (1) to about five (5) gallons with about five (5) gallons of syrup being a common size. A valve with an attached cap is then installed within the spout so as to seal the pouch. The pouch is then placed within the corrugated box. The box is sealed and shipped to the customer.

Upon delivery of the package to the customer, the customer opens one end of the box and attaches a suction line from the dispensing equipment to the valve of the pouch. The pouch generally stays within the box during use. The box functions to support and protect the pouch while the beverage is being drained from the pouch. Likewise, the dip strip provides a liquid pathway within the pouch. The dip strip prevents the pouch from falling upon itself and cutting off access to the valve. Examples of known bag-in-box designs include commonly owned U.S. Pat. Nos. 4,893,732; 4,998,990; and 5,147,071, all entitled "Collapsible Bag With Evacuation Pathway And Method For Making The Same". The disclosures of these patents are incorporated herein by reference.

One drawback with the known bag-in-box package designs is that most packages are simply too big for lower volume customers. The customer may not be able to consume all of the beverage in the package before the recommended expiration date. As a result, some of the beverage may be wasted. Likewise, the total cost of the typical beverage delivered in a bag-in-box package may be too expensive for a lower volume customer. This expense may be related to the cost of the beverage itself, the cost of the bag-in-box package, or the cost of delivering the package to the customer. It may not make economic sense for such a customer to purchase a beverage in a bag-in-box format if the beverage will not be consumed in time, if the packaging costs are too high, or if the delivery costs are too high.

What is needed, therefore, is a means for the delivery and use of smaller of amounts of beverages than is currently available with conventional bag-in-box designs. The means should be able to provide beverages, such as syrups and concentrates, to lower volume customers in a practical, efficient, but inexpensive manner.

SUMMARY OF THE INVENTION

The present invention provides a pouch for dispensing a beverage. The pouch includes a pair of opposing walls with a first half and a second half. A valve is inserted within one of the walls at the first half of the pouch. The valve is configured to be operable with conventional beverage dispenser equipment. The pouch also includes various elements for hanging the pouch by its second half such that the pouch may be hung and dispense the beverage through the valve.

Specific embodiments of the present invention include the walls being substantially rectangular in shape. The walls may be made from a single or a multiple ply thermoplastic material. The material may be a linear low density polyethylene. The walls may be made from one or more sheets of material. If two sheets are used, the walls may include a first edge, a second edge, a third edge, and a fourth edge. The walls are heat-sealed along these edges. If multiple sheets are used, the sheets of material form a first edge, a second edge, third edge, and a base. The walls are heat-sealed together along these edges and the base.

The hanging elements may include a hanging hole positioned within the second half of the walls. The hanging hole may be positioned within the heat seal. The hanging hole may include a metal or plastic reinforcing layer or a connector positioned therein. The hanging elements also may include a rod seam or a hook fitment.

The method of the present invention provides for the use of a fluid pouch. The method includes the steps of inserting a valve into a first end of the pouch; forming the pouch along a first side, a second side, and a third side; filing the pouch with a fluid through a fourth side; sealing the fourth side of the pouch; delivering the pouch to a customer; hanging the pouch by a second end; and attaching a beverage dispenser line to the valve. The delivery step also may include shipping the pouch by mail or by a package delivery service. The method may further include the steps of placing one or more pouches in a delivery box before the delivery step and then removing the pouches from the delivery box after the delivery step. The method may further include the step of draining the fluid from the pouch via the valve.

A further method of the present invention provides for the use of a fluid pouch. The method includes the steps of forming the pouch from multiple sheets of material along a base, a first side, and a second side; filing the pouch with a fluid through a third side; inserting a valve into the third side of the pouch; sealing the third side of the pouch; delivering the pouch to a customer; hanging the pouch; and attaching a beverage dispenser line to the valve.

Other objects, features, and advantages of the present invention will become apparent upon review of the following detailed description of the preferred embodiments of the invention when taken in conjunction with the drawings and the appended claims.

DETAILED DESCRIPTION OF THE INVENTION

Figure 1:
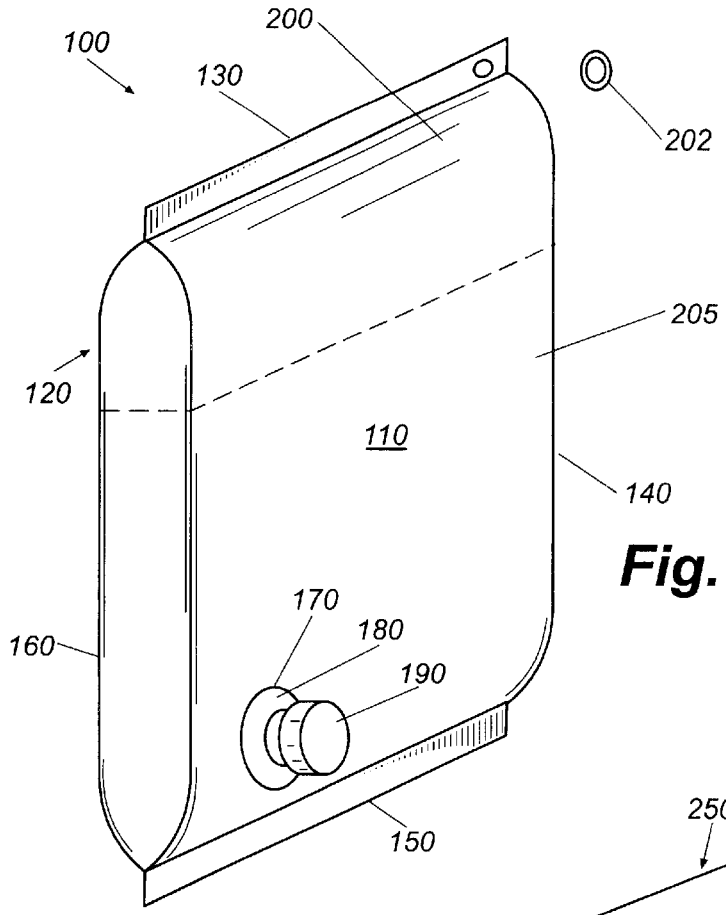
FIG. 1 is a perspective view of a pouch of the present invention.

Referring now to the drawings, in which like numerals refer to like elements throughout the several views, FIG. 1 shows a pouch 100 of the present invention. The pouch 100 may be substantially rectangular in shape. The pouch 100 may be formed from two (2) opposing sheets of material, an upper wall 110 and a bottom wall 120. (The use of the terms "upper" and "lower" is meant as a description of the relative relationship of the walls as opposed to an actual physical position.)

The walls 110, 120 of the pouch 100 may be made from a conventional thermoplastic material. Further, the walls 110, 120 may be a single ply or a multiple ply material. A preferred wall 110, 120 may have two plies of material, an inner ply and an outer ply. The inner ply may be a web of two (2) mil linear low density polyethylene ("LLDPE") or similar materials. The outer ply may be a four (4) mil co-extrusion layer of LLDPE/nylon/LLDPE, with tie layers on each side of the nylon, or similar materials. The two (2) LLDPE layers are preferably about 1.4 mil, the nylon about 1.0 mil, and the tie layers about 0.1 mil. The pouch 100 may hold about one (1) to about three (3) liters or so of a beverage. The pouch 100 may be about six (6) to about fourteen (14) inches in length and about five (5) to about ten (10) inches in width. The pouch 100, however, may be manufactured in any convenient size or shape.

The walls 110, 120 are sealed together in a conventional fashion such that the pouch 100 has a first edge 130, a second edge 140, a third edge 150, and a fourth edge 160. A heat seal 165 may be formed along the edges 130, 140, 150, 160. One of the walls 110, 120 has a hole 170 punched therein with a valve 180 positioned within the hole 170. The valve 180 is generally heat sealed into place within the wall 120, 130. The valve 180 is generally closed with a cap 190. A spout is generally not used herein.

One of the edges 130, 140, 150, 160 preferably has a hanging hole 200 positioned therein. The hanging hole 200 may be a hole in the material of the pouch 100, preferably along the heat seal 165. The size of the heat seal 165 may be increased in the vicinity of the hanging hole 200 or multiple heat seals 165 may be applied such that the hanging hole 200 can support the pouch 100 without pulling or tearing. The hanging hole 200 may be re-enforced with a metal or plastic layer. The pouch 100 may be hung directly by the hanging hole 200. Further, a connector 202 or some similar structure may be inserted within the hanging hole 200 such that the pouch 100 also may be hung by the connector 202. The connector 202 may be in the form of a hook, a ring, or the like capable of supporting the pouch 100. The pouch 100 may have any number of hanging holes 200 and connectors 202.

The pouch 100 may be manufactured by the "form, fill, and seal" method. This method is in contrast to the usual method of filling a pre-made bag-in-box pouch through the spout of the formed pouch. The form, fill, and seal method includes the steps of heat sealing the second edge 140, the third edge 150, and the fourth edge 160 of the walls 110, 120 in a conventional manner (the "form" step). The valve 180 is generally inserted into one of the walls 110, 120 before the forming step. The pouch 100 is then filled with a beverage 205 through the unsealed first edge 130 (the "fill" step). The first edge 130 is then sealed to form the pouch 100 (the "seal" step). Alternatively, the pouch 200 may be completely sealed and then filled through the valve 180. The hanging hole 200 may then be inserted within the heat seal 165 of the first edge 130. Alternatively, the hanging hole 200 could have been inserted into any of the edges 130, 140, 150, 160 at any time before the final sealing step.

Figure 2:
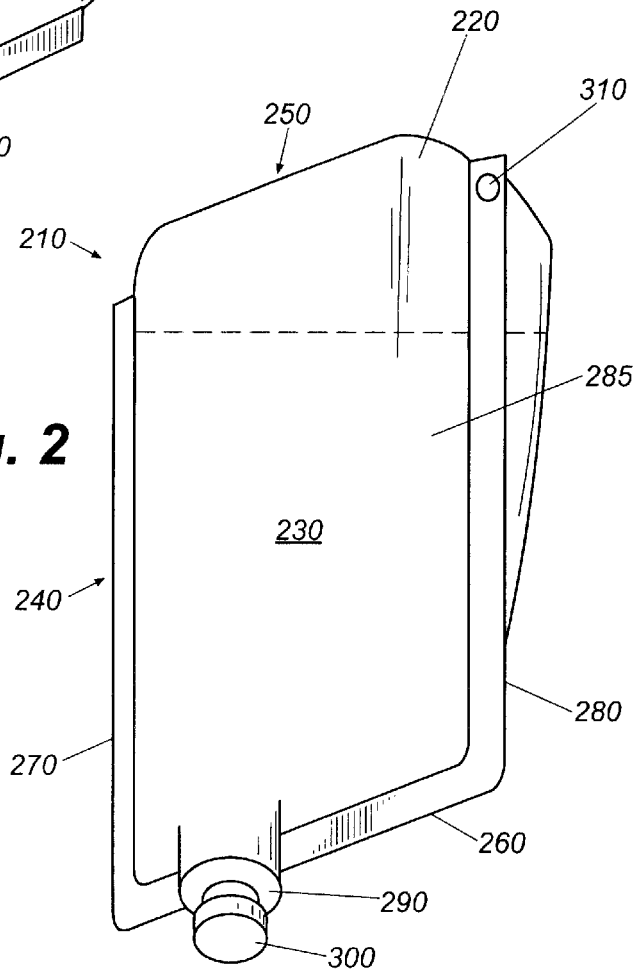
FIG. 2 is a perspective view of an alternative embodiment of the pouch of the present invention.

FIG. 2 shows an alternative embodiment of the present invention, a gusset pouch 210. The gusset pouch 210 is made from one or more sheets 220 of a thermoplastic material. The gusset pouch 210 also may be created and filled in the form, fill, and seal method. The sheets 220 are arranged so as to form an upper panel 230, a lower panel 240, and a base panel 250. The base panel 250 is heat sealed to the upper and lower panels 230, 240. The upper and lower panels 230, 240 form a first edge 260, a second edge 270, and a third edge 280. The second and third edges 270, 280 of the pouch 210 also are heat-sealed together in a conventional manner. Alternatively, the pouch 210 may be constructed from a single sheet 220 of material that is folded to form the panels 230, 240, 250. The pouch 210 is then filled with a beverage 285 through the first edge 260. A valve 290 is inserted along the first edge 260 and the first edge 260 and the valve 290 are heat sealed together. Alternatively, the pouch 210 may be completely sealed and then filled with the beverage through the valve 290. The valve 290 is generally enclosed with a cap 300. A hanging hole 310 may be positioned within a heat seal 305 along the second edge 270, the third edge 280, or surrounding the base panel 250. The hanging hole 310 thus supports the alternative pouch 210 without pulling or tearing.

Figure 3:
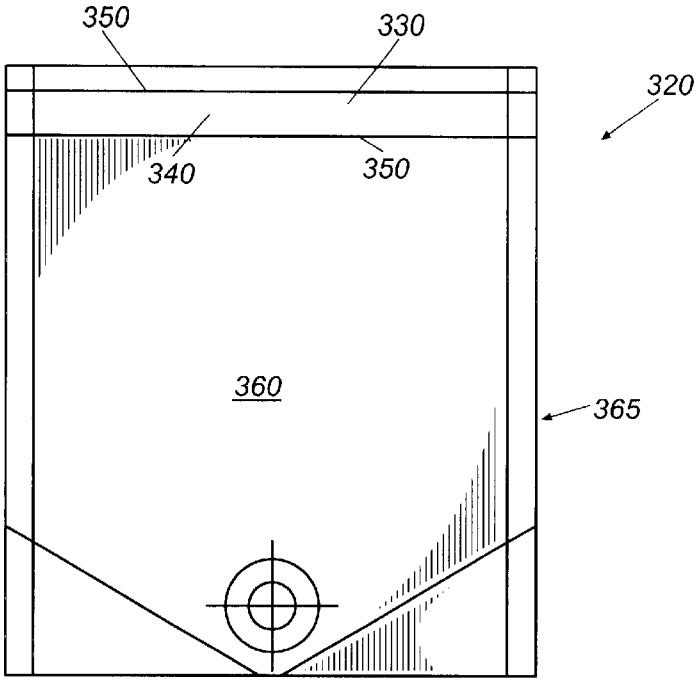
FIG. 3 is a plan view of an alternative embodiment of the pouch of the present invention.

FIG. 3 shows a further embodiment of the present invention. Instead of a hanging hole 200, 310, a pouch 320 has a rod seam 330 formed therein. The rod seam 330 may be formed by heat sealing a substantially rectangular strip of material 340 along its edges 350 to one wall 360, 365 of the pouch 320 via heat seal 367. Alternatively, the heat seal 367 forming the walls 360, 365 could simply be repeated with a space in between such that the seam 330 is created.

Figure 4:
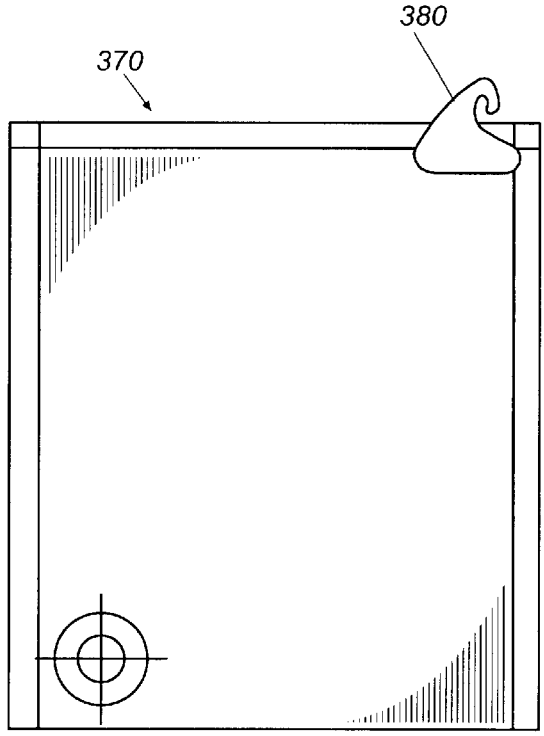
FIG. 4 is a plan view of an alternative embodiment of the pouch of the present invention.

FIG. 4 shows a further embodiment of the present invention. An alternative pouch 370 has a hook fitment 380. The hook fitment 380 is positioned within a heat seal 385 or otherwise attached to one of the walls 390, 395 of the pouch 370 by conventional means. The hook fitment 380 acts in a similar manner to the hanging holes 200, 310 or the rod seam 330 in that the hook fitment 380 can support the alternative pouch 370 with pulling or tearing.

After the pouch 100, 210, 320, 370 (hereinafter "pouch 100") has been formed, filled, and sealed, the pouch 100 is delivered to the customer. Although the pouch 100 could be delivered to the customer in the conventional manner, i.e., delivered directly to the customer by a delivery truck or similar means, the pouch 100 generally is small enough such that it may be sent to the customer via the mail or via conventional types of package delivery services. The pouch 100 may be shipped in a delivery box 400 or in any conventional type of delivery package that would prevent the pouch 100 from being punctured or otherwise damaged in transit. The delivery box 400 need not be the rigid corrugated normally associated with bag-in-box packages. More than one pouch 100 per box 400 may be sent to a customer at a time.

Figure 5:
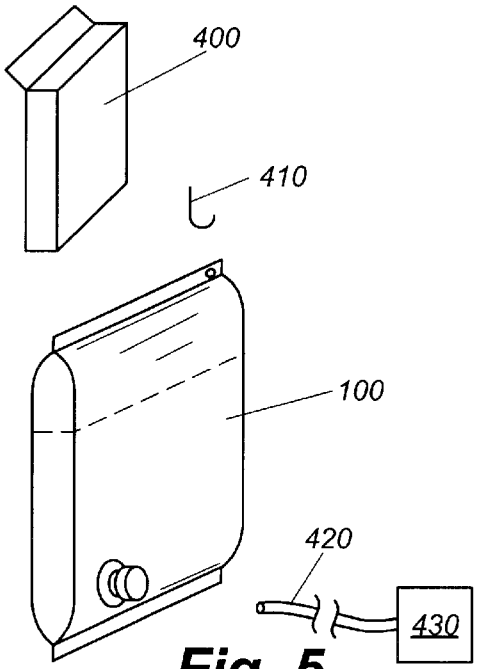
FIG. 5 is a perspective view of the pouch of the present invention with a delivery hook and a beverage dispenser line.

As is shown in FIG. 5, after the customer receives the pouch 100, the customer removes the pouch or pouches 100 from the delivery box 400 and hangs the pouch 100 on a hook 410 via the hanging hole 200, 310, the connector 202, or the hook fitment 380. Alternatively, a rod could be used with the rod seam 330. The customer then attaches a line 420 leading to a conventional beverage dispenser 430 to the valve 180. The beverage 205, 285 then drains from the pouch 100 such that the beverage dispenser 430 provides a carbonated soft drink, juice, or the like in a conventional manner. The valve 180 is configured to be operable with the beverage dispenser 430.

Because the pouch 100 is hung from the hook 410, the pouch 100 does not need a conventional dip strip positioned therein. Likewise, the pouch 100 does not need to remain in its box 400 as in typical bag-in-box designs. The use of the hook 410 to provide a gravity feed ensures that the beverage 205, 285 will flow out of the pouch 100 without blockage or delay. Further, because the pouch 100 is manufactured according to the form, fill, and seal method, a conventional spout is not needed. Finally, because the pouch 100 is relatively small, the pouch 100 can be sent through the mail or other conventional types of delivery services in an economically reasonable fashion.

The present invention thus provides an inexpensive means to deliver smaller amounts of beverages, such as syrups, concentrates, or other fluids, to customers than is currently possible with known bag-in box designs. Not only is the pouch 100 smaller, but the pouch 100 requires less material, fewer elements, and less cost to construct and use than is possible with known bag-in-box designs. The pouch 100 herein allows smaller customers the same benefits of a bag-in-box packages without the usual cost, size, or expense.

It should be understood that the foregoing relates only to the preferred embodiments of the present invention and that numerous changes may be made herein without departing from the general spirit and scope of the invention as defined by the following claims.

We claim:

1. A method for the use of a fluid pouch, comprising the steps of:

inserting a valve into a first end of said pouch;

forming said pouch along a first side, a second side, and a third side;

filling said pouch with a fluid through a fourth side;

sealing said fourth side of said pouch;

delivering said pouch to a customer;

hanging said pouch by a second end; and attaching a line operably connected to a beverage dispenser to said valve.

2. The method of claim 1, wherein said delivery step comprises shipping said pouch by mail.

3. The method of claim 1, wherein said delivery step comprises shipping said pouch by a package delivery service.

4. The method of claim 1, further comprising the steps of placing said pouch in a delivery box before said delivery step and removing said pouch from said delivery box after said delivery step.

5. The method of claim 4, wherein said step of placing said pouch in said delivery box comprising placing a plurality of said pouches in said delivery box.

6. The method of claim 1, further comprising the step of draining said fluid from said pouch via said value.

7. A method for the use of fluid pouch, said pouch including a first sheet and a second sheet, comprising:

inserting a hole into a first end of the first sheet;

inserting a valve without a spout into the said first end of the first sheet;

joining said first sheet and said second sheet along a first side, a second side, and a third side so as to form the pouch;

filling the pouch with a fluid through a fourth side; and sealing said fourth side of the pouch.

8. The method of claim 7, further comprising the step of inserting a second hole into said fourth side.

9. The method of claim 8, further comprising the step of inserting a connector into said second hole.

10. The method of claim 8, further comprising the step of inserting a hook fitment into said second hole.

11. The method of claim 7, wherein said fluid comprises a fluid or a concentrate.

* * * * *